United States Patent [19]

Lindqvist

[11] 3,966,249

[45] June 29, 1976

[54] ROTATOR

[75] Inventor: Jonas Herman Lindqvist, Hudiksvall, Sweden

[73] Assignee: Hiab-Foco Aktiebolag, Hudiksvall, Sweden

[22] Filed: June 6, 1974

[21] Appl. No.: 476,852

[52] U.S. Cl. ..... 294/88; 37/183 R; 92/2; 173/152; 214/138 R; 285/136

[51] Int. Cl.[2] ..... B25B 1/00; B66C 1/00

[58] Field of Search ..... 92/2, 61, 71, 76, 106, 92/116, 167; 173/57, 163, 152; 175/170, 173; 214/138 R; 285/136, 190; 37/183 R, 103, 118 R; 294/88

[56] References Cited

UNITED STATES PATENTS

| | | | |
|---|---|---|---|
| 2,660,816 | 12/1953 | Maxwell | 214/138 R |
| 2,998,084 | 8/1961 | Johnson et al. | 175/170 X |
| 3,101,150 | 8/1963 | Janson et al. | 214/138 R |
| 3,301,334 | 1/1967 | Odgers et al. | 173/163 X |
| 3,357,312 | 12/1967 | Rogov et al. | 92/61 X |
| 3,390,728 | 7/1968 | Bartos | 173/163 |
| 3,435,774 | 4/1969 | Parrett | 92/71 X |
| 3,592,570 | 7/1971 | Bartos | 173/57 X |
| 3,599,801 | 8/1971 | Roll et al. | 214/138 R |
| 3,623,558 | 11/1971 | Brown | 173/163 X |
| 3,800,887 | 4/1974 | West | 173/57 |
| 3,914,886 | 10/1975 | Berg et al. | 285/136 X |

*Primary Examiner*—Martin P. Schwadron
*Assistant Examiner*—Abraham Hershkovitz
*Attorney, Agent, or Firm*—Newton, Hopkins & Ormsby

[57] ABSTRACT

A rotator of the kind intended to be positioned between a crane hoisting boom and a lifting tool suspended in said boom and provided with hydraulic tool actuating means. The rotator is mounted on a vertical shaft in a manner permitting it some flexion sidewise without occurrence of fractures or breaks causing leakage of the pressurized medium and also in a manner making exchange of the sealing rings easy in that the rotator need not be dismantled for this exchange.

4 Claims, 2 Drawing Figures

ROTATOR

BACKGROUND OF THE INVENTION

The present invention relates to rotators of the kind to be positioned between a crane hoisting boom and a lifting tool suspended in said boom and provided with hydraulic means intended to actuate the tool. In the rotator stand is mounted a vertical shaft which may be rotated by means of a motor, preferably supported by said stand. The shaft is provided with an upwardly extending prolongation portion which is enclosed in a sleeve and provided with two longitudinally extending bores through which pressurized medium may be supplied to and discharged from, respectively, the hydraulic means. Each bore has a lateral passageway debouching into its associated channel constituting a distribution chamber and collection chamber, respectively, for the pressurized medium.

The rotator is primarily intended for use in connection with a gripping tool which is operated by a hydraulic piston-and-cylinder unit and intended for loading lumber by means of lifting cranes onto loading vehicles. Rotators of this kind are exposed to extremely rough handling and considerable stress is exerted on the vertical shaft because of the frequent changes of the direction of rotation. Also the shaft bearings are exposed to heavy load. All these factors contribute to making it difficult to seal-off the pressurized medium at the points of the transitions between the stand and the shaft.

SUMMARY OF THE INVENTION

The purpose of the present invention is to solve this problem. It is characteristic of the invention that the prolongation portion has a good rotational fit relative to the sleeve and that it extends upwards into a tubular top portion of the stand, and that said sleeve is non-rotationally mounted relative to the stand but arranged for some movement in the lateral direction. The invention provides the advantage that some flexion in the outwards direction is allowed for the shaft and its upwardly extending prolongation portion without affecting the mounting of the prolongation portion in the sleeve, the latter, on account of its particular mounting in the stand, being able to follow the lateral flexion or thrusts of the shaft without occurrence of fractures or loss of sealing effect. It also becomes possible to choose a bearing material for the sleeve which is suitable for the purpose and to construct the latter with the exclusive view to promote transfer of the pressurized medium to and from the hydraulic piston-and-cylinder unit of the tool via the vertical shaft of the rotator. Also from a maintenance point of view considerable and important advantages are obtained in that demounting of the sleeve becomes easy for the purpose of e.g. exchanging the sealing rings without it being necessary to dismount the entire rotator as hitherto has been the case. The sleeve and the shaft are well protected inside the top portion of the stand.

BRIEF DESCRIPTION OF THE DRAWINGS

The invention will be described more in detail in the following with reference to the accompanying drawing, wherein.

DETAILED DESCRIPTION OF A PREFERRED EMBODIMENT

Figure 1:
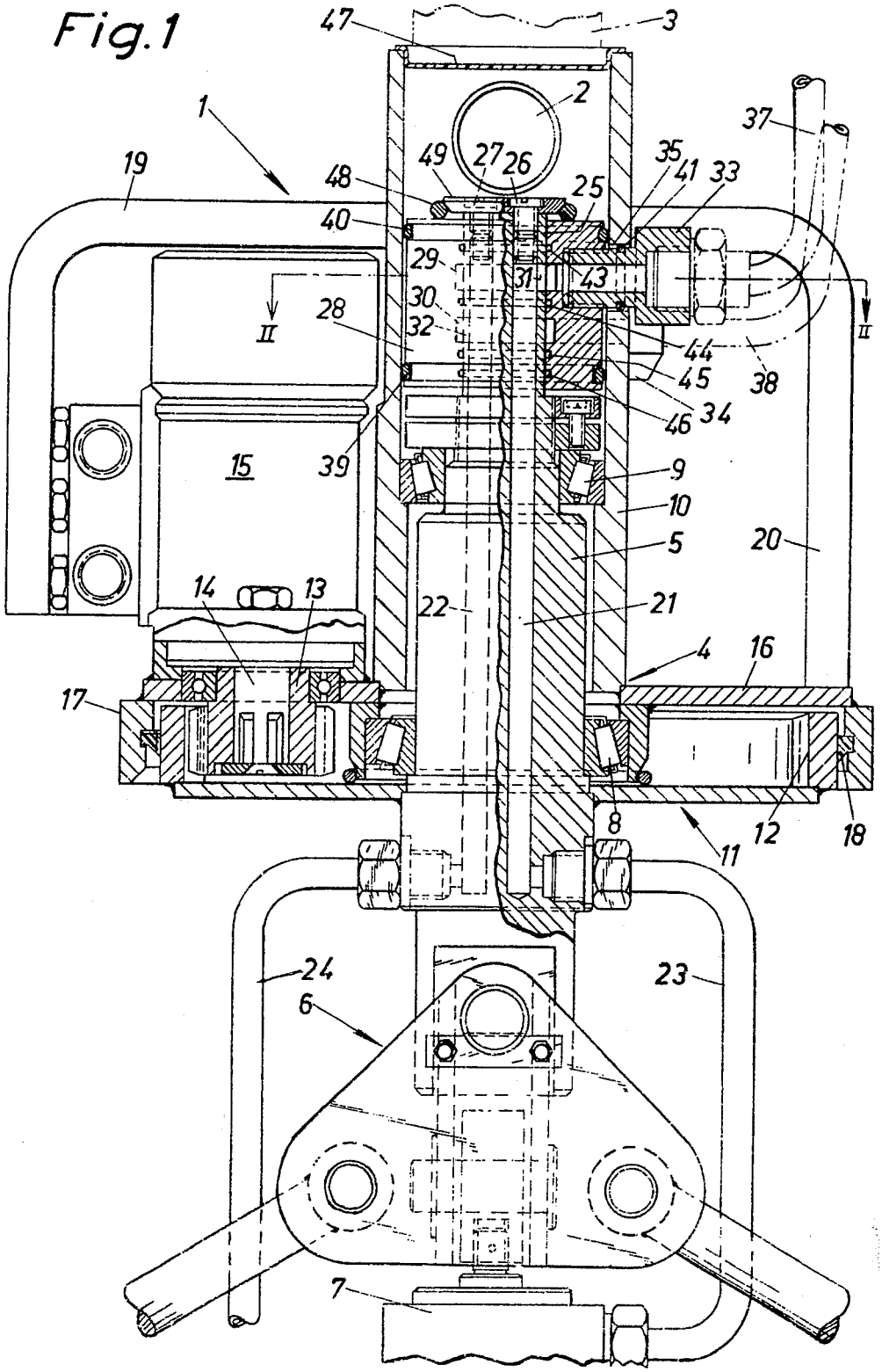
FIG. 1 is a side view showing partly in vertical longitudinal section a rotator in accordance with the invention.
Figure 2:
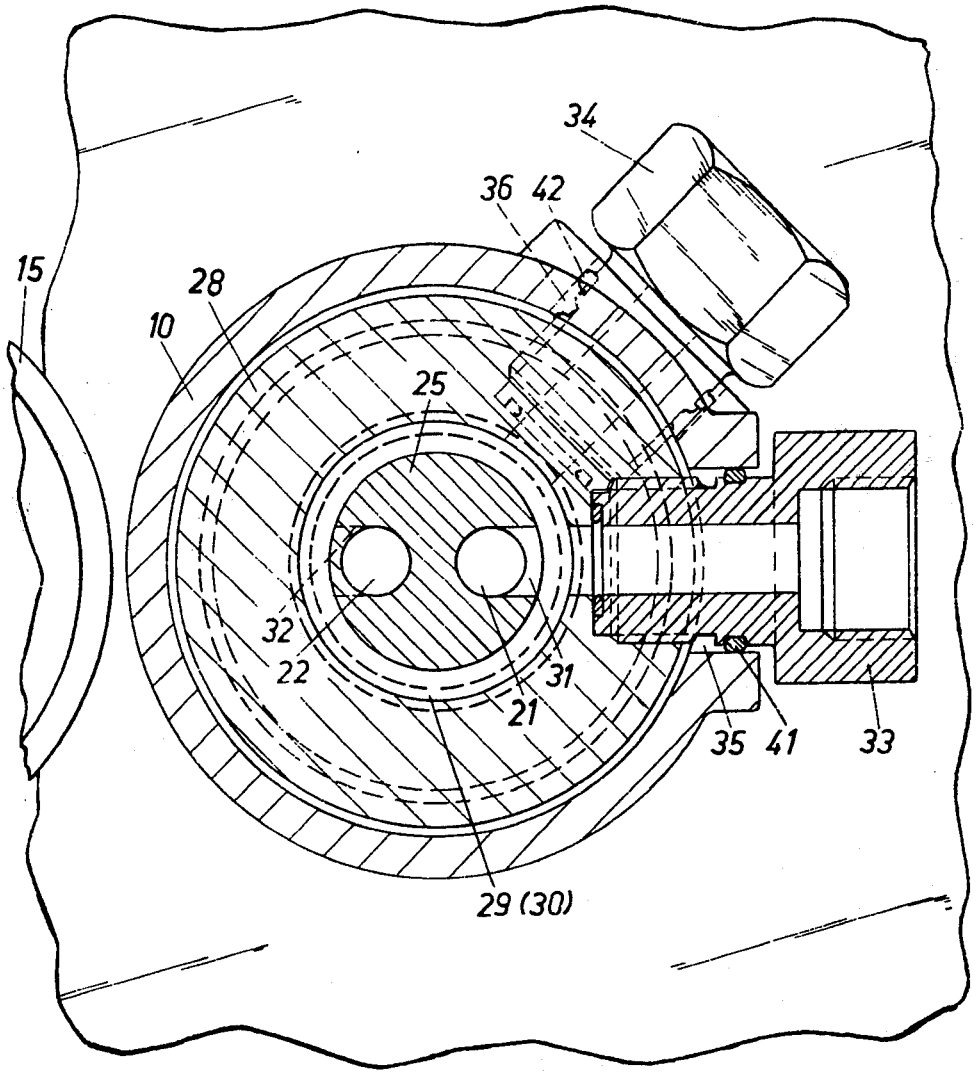
FIG. 2 shows on an enlarged scale a horizontal cross-section through the rotator along line II—II of FIG. 1.

The rotator 1 illustrated in the drawing is suspended in the hoisting boom 3 of a crane (not illustrated) by means of link arms 2 or the like. The crane may be mounted on the loading platform of a loading vehicle. At the lower end of a vertical shaft 5 which is rotatably mounted in the rotor stand 4 is suspended a tool 6 which may be e.g. a gripping tool having two fork legs (not illustrated) which may be swung towards and away from one another by means of a hydraulic piston-and-cylinder unit 7.

The vertical shaft 5 which is rotatably mounted in a tubular portion 10 of the stand 4, by means of two roller bearings 8, 9 is provided with a gear wheel 11 having a gear rim 12 with internal cogs thereon. The gear wheel 11 cooperates with a gear wheel 13 which has external cogs and is mounted on the shaft 14 of a hydraulic motor 15 supported by the stand 4.

The stand 4 is provided at its lower end with a downwardly open hood 16 covering the gear wheel 11 and provided with a collar or flange 17, and a sealing ring 18 is inserted between said hood flange 17 and the jacket face of the cog rim 12.

In addition, the rotator 1 is provided with protective frames 19, 20 preventing the rotator from being damaged, should the latter, during operation, hit any fixed object in its path of movement.

The shaft 5 is provided with two longitudinal bores 21, 22 each one of which is connected to its respective end of the hydraulic piston-and-cylinder unit 7 by means of a hose 23 and 24, respectively. Above the upper roller bearing 9 the shaft 5 is provided with a prolongation portion 25 in the form of a trunnion up into which extend the two bores 21 and 22, the upper end of each bore being closed by a stopper 26 and 27, respectively. Over said prolongation portion 25 is fitted from above a sleeve 28 presenting on its inside two peripherally extending channels 29, 30 extending at two different levels. Each channel 29, 30 debouches into a lateral passageway 31 and 32 extending from its respective bore 21 and 22. Opposite each peripheral passageway 29, 30 a nipple 33, 34 is screwed into the sleeve 28, said nipples freely passing its respective aperture 35, 36, and a hose 37 and 38, respectively, is connected to each one of said nipples so as to lead pressurized medium to and from a source of pressurized medium (not illustrated). Between the sleeve 28 and the tubular portion 10 of the stand 4 are introduced sealing rings 39, 40 of rubber or some other suitable resilient material. Also between the nipples 33, 34 and their associated apertures 35, 36 in the tubular stand portion 10 are inserted sealing rings 41, 42 of some resilient material. Finally, also internally of the sleeve 28 are positioned sealing rings 43, 44, 45 and 46, whereby the pressurized medium is properly sealed-off between the peripheral channels 29, 30.

At the upper end of the tubular stand portion 10 is mounted a dust-proof lid 47. Also at the upper end of the sleeve 28 between the latter and the prolongation portion 25 is disposed a dust-proof ring 48 made of some resilient material and maintained in position by a washer 49 mounted at the upper end of the prolongation portion 25.

The sleeve 28 may be inserted with ample play through the upper end of the tubular stand portion 10. When the nipples 33, 34 have been screwed into position, the sleeve 28 is prevented from turning together with the shaft 5. Owing to the particular mounting of the sleeve 28 with its resilient rings 39 and 40 and the resilient rings 41, 42 positioned in the apertures 35, 36, the sleeve 28 may take part in any outwards flexions of the shaft prolongation 25 without risk of loss of the sealing effect between the sleeve and the prolongation portion.

As clearly appears from FIG. 1 it is possible, when the need arises, to exchange the sealing rings, e.g. the ones numbered 43, 44, 45, and 46 after simply having pulled out the sleeve 28. No dismantling of the shaft 5 thus is necessary.

The embodiment as illustrated and described is to be regarded as an example only and the various details of the rotator may be constructively altered in a variety of ways within the scope of the appended claims. Although it may be preferable that the prolongation portion 25 of the shaft 5 is in the form of a trunnion having a smaller diameter than the rest of the shaft, there are, of course no obstacles against the shaft end above the upper roller bearing 9 having the same diameter as the rest of the shaft. An embodiment of this nature is embraced by the claims. Finally should be mentioned that the shaft drive may be effected by other means than a motor 15 positioned on the stand 4.

What I claim is:

1. An improved rotator adapted to be positioned between a crane hoisting boom and a fluid actuated lifting tool, comprising in combination:

a rotator stand having a portion presenting a continuous vertical bore;

a vertical shaft having a lower end projecting downwardly from said stand, the remainder of said shaft being received in said bore;

bearing means disposed within said bore and engaging an intermediate section of said shaft for supporting said shaft for rotation and against axial displacement, said shaft having an upper end projecting above said bearing means and located wholly within said bore, said bore being of larger diameter than said upper end of the shaft;

motor means carried by said stand and drivingly connected to said shaft below said bearing means for selectively rotating said shaft;

a sleeve enclosing said upper end of said shaft within said bore, said sleeve rotatably engaging said shaft and having an outer diameter less than the diameter of said bore whereby said upper end of the shaft may freely flex laterally together with said sleeve incident to shaft loading without interference between said sleeve and said stand;

passage means defining a pair of fluid conduits extending through said sleeve and into said shaft to said lower end thereof for establishing pressure fluid connection between the upper and the lower ends of said shaft; and means for preventing rotation of said sleeve relative to said stand while allowing said lateral flexing of the upper end of said shaft with said sleeve.

2. An improved rotator as defined in claim 1 including resilient sealing means bridging the gap between said sleeve and said bore to allow said lateral flexing of the upper end of the shaft and said sleeve without loss of sealing contact between said sealing means and the sleeve and said bore.

3. An improved rotator as defined in claim 2 wherein said means for preventing rotation comprises a pair of fluid coupling nipples each threadedly engaged with said sleeve and freely projecting through said stand.

4. A rotatable coupling device for connecting a fluid actuated tool to a crane boom, comprising in combination:

a stand having a continuous vertical bore extending completely therethrough;

a shaft having a lower end extending below said stand with the remainder of said shaft projecting upwardly within said bore;

bearing means seated in said bore for supporting an intermediate section of said shaft whereby to leave an unsupported upper end of the shaft within said bore;

said upper end of the shaft projecting above said bearing means and located wholly within said bore;

means at said lower end of the shaft for attaching a fluid actuated tool thereto and including a pair of fluid couplings;

power means on said stand and drivingly connected with said shaft below said bearing means for selectively rotating said shaft;

a removable cover at the upper end of said bore;

a sleeve in rotational enclosing engagement with the upper end of said shaft, said sleeve being of an external diameter smaller than said bore to permit limited lateral deflection of said upper end of the shaft with said sleeve, said shaft having longitudinal bores connecting with said fluid couplings, and said sleeve and the upper end of the shaft defining a pair of fluid channels connecting with said longitudinal bores, said sleeve being removable through the upper end of said bore;

a pair of fluid coupling nipples threadedly engaged in the side of said sleeve and communicating with said channels, said stand having openings therein transverse to said bore and receiving said nipples with clearance whereby said sleeve is blocked against any substantial rotation with respect to said housing while being permitted of said limited lateral deflection with said shaft; and resilient sealing means between said nipples and said housing, and resilient sealing means between said sleeve and said bore.

* * * * *